US005160189A

United States Patent [19]

Johnston et al.

[11] Patent Number: 5,160,189

[45] Date of Patent: Nov. 3, 1992

[54] AUTOMATIC LOCKING DEVICE FOR MOVABLE SHELVING

[75] Inventors: Daniel J. Johnston, Porterfield; Russell Cleven, Marinette, both of Wis.

[73] Assignee: Automated Storage & Retrieval Systems of America, New York, N.Y.

[21] Appl. No.: 505,248

[22] Filed: Apr. 3, 1990

[51] Int. Cl.[5] ..... A47B 53/00

[52] U.S. Cl. ..... 312/201; 188/82.2

[58] Field of Search ..... 312/198, 199, 200, 201; 188/82.1, 82.2, 82.3, 82.34

[56] References Cited

U.S. PATENT DOCUMENTS 3,168,361 2/1965 Naito et al. .
3,615,122 10/1971 Naito et al. .
3,648,241 3/1972 Naito et al. .
4,000,821 1/1977 Naito et al. .
4,033,649 7/1977 Naito et al. .
4,256,355 3/1981 Yamaguchi et al. .
4,412,772 11/1983 Naito et al. .
4,422,816 12/1983 Naito et al. .
4,615,449 10/1986 Naito et al. .
4,616,889 10/1986 Peterman ..... 312/201

FOREIGN PATENT DOCUMENTS 1214028 11/1970 United Kingdom .

*Primary Examiner*—Joseph Falk
*Assistant Examiner*—Gerald Anderson
*Attorney, Agent, or Firm*—Rosen, Dainow & Jacobs

[57] ABSTRACT

A movable shelving system comprising a locking system that automatically activates when a rack is moved a short distance and that allows a user to reset or open the lock at any time. A scissors type element is mounted across adjacent racks and is connected via a slip clutch to a drive rod such that separating the racks causes the rod to rotate displacing a bracket which toggles a locking device.

18 Claims, 6 Drawing Sheets

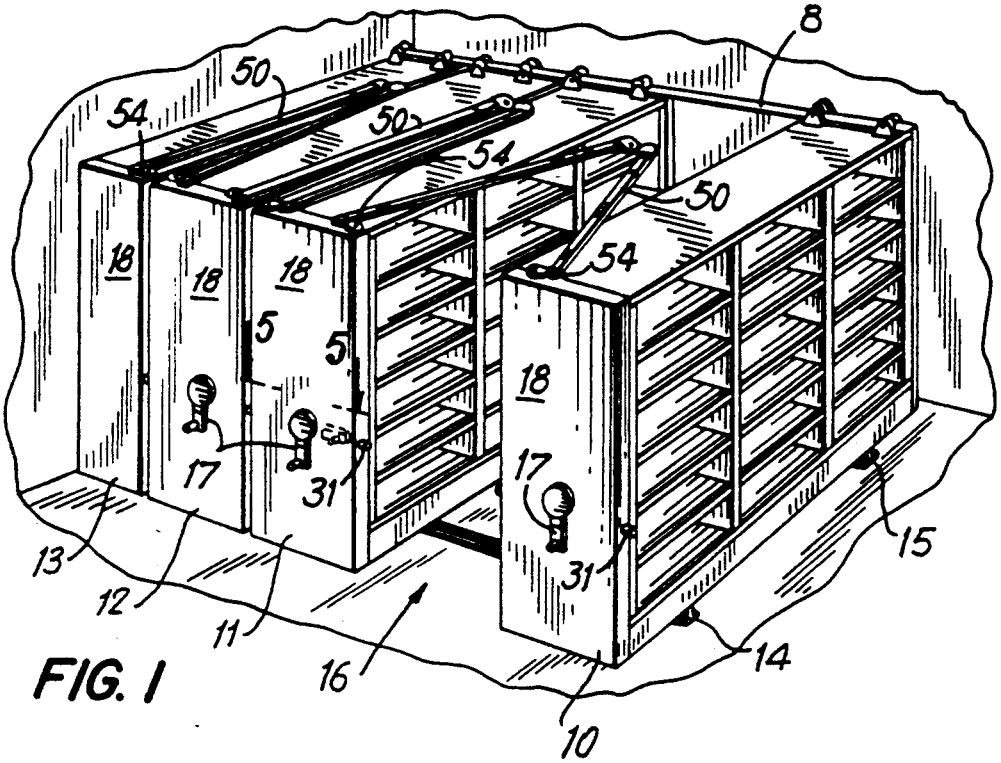
FIG. 1
FIG. 4
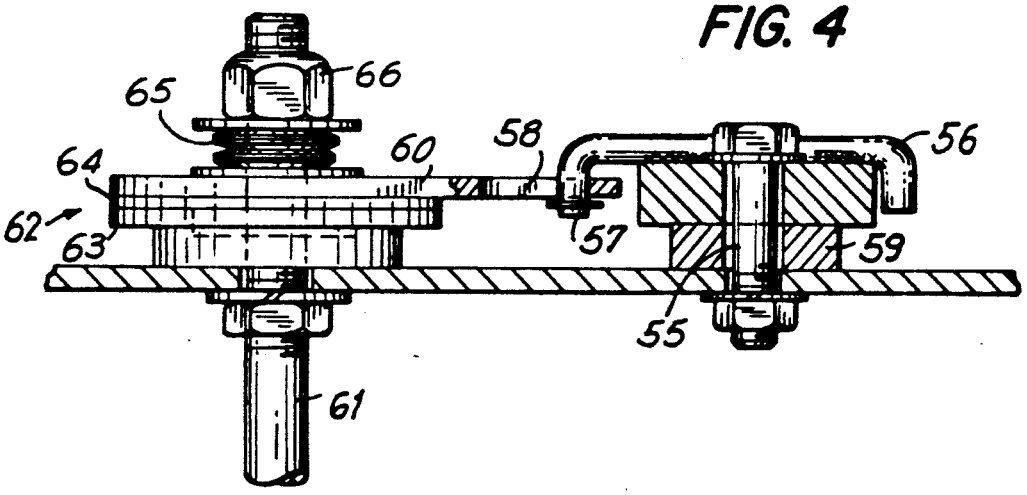

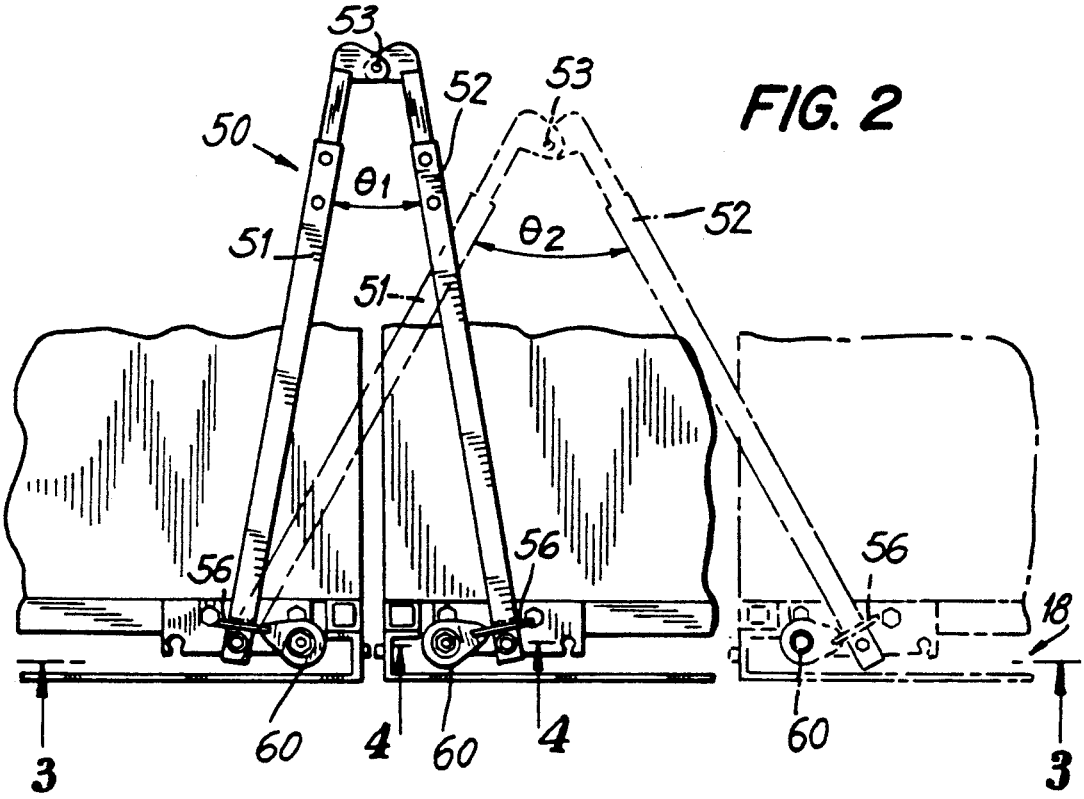
FIG. 2
FIG. 3
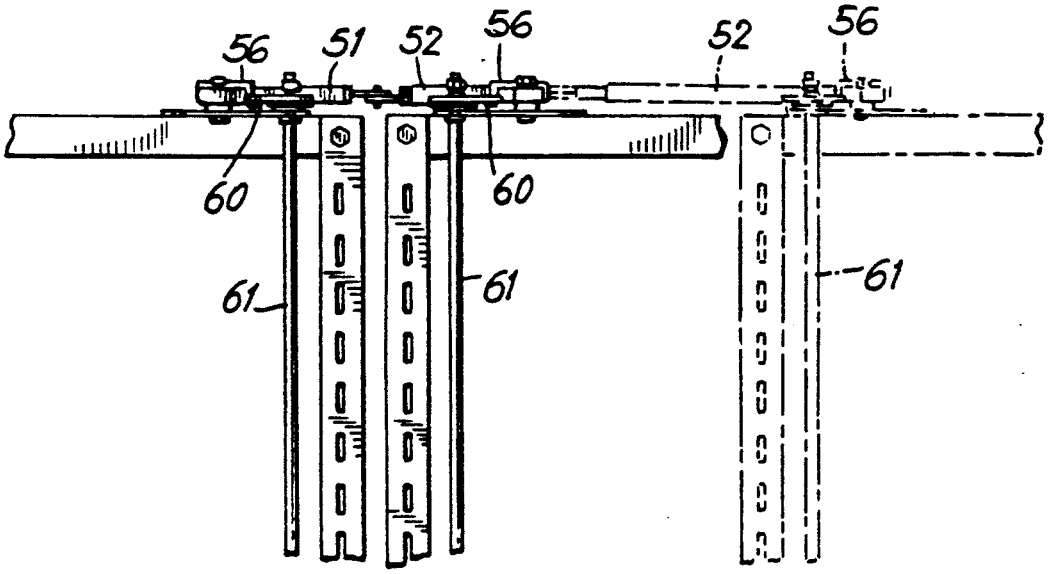

FIG. 7
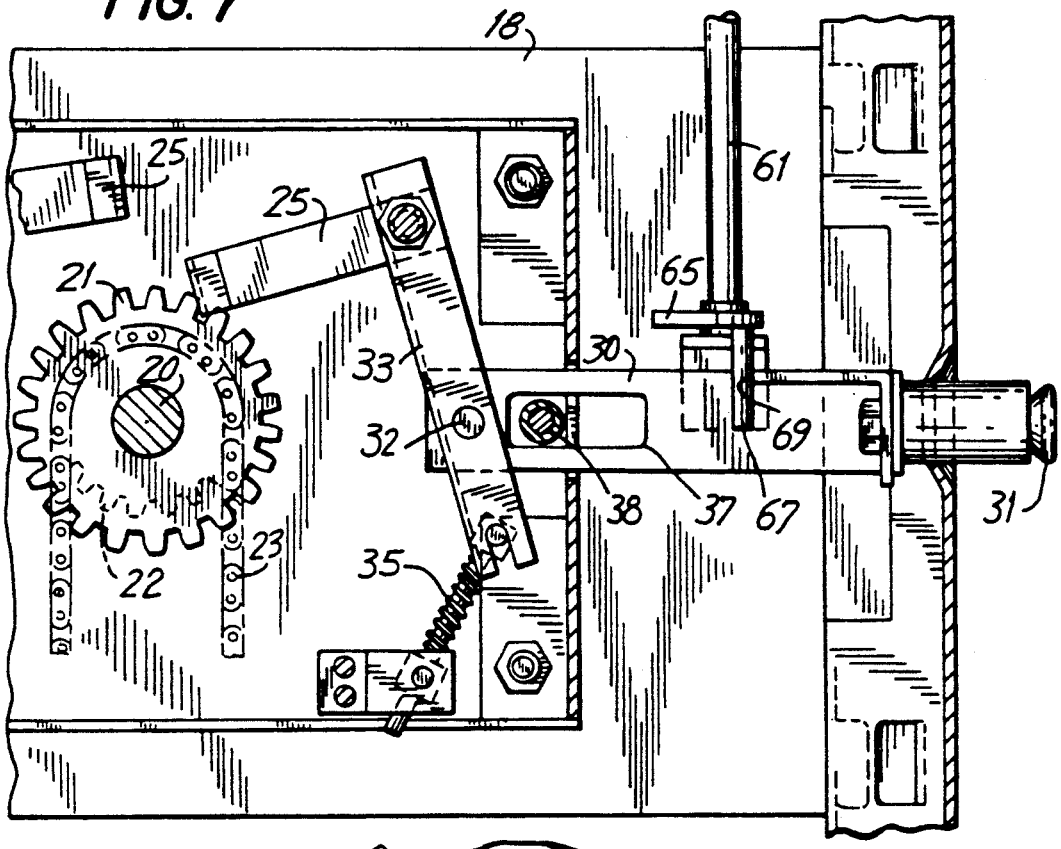
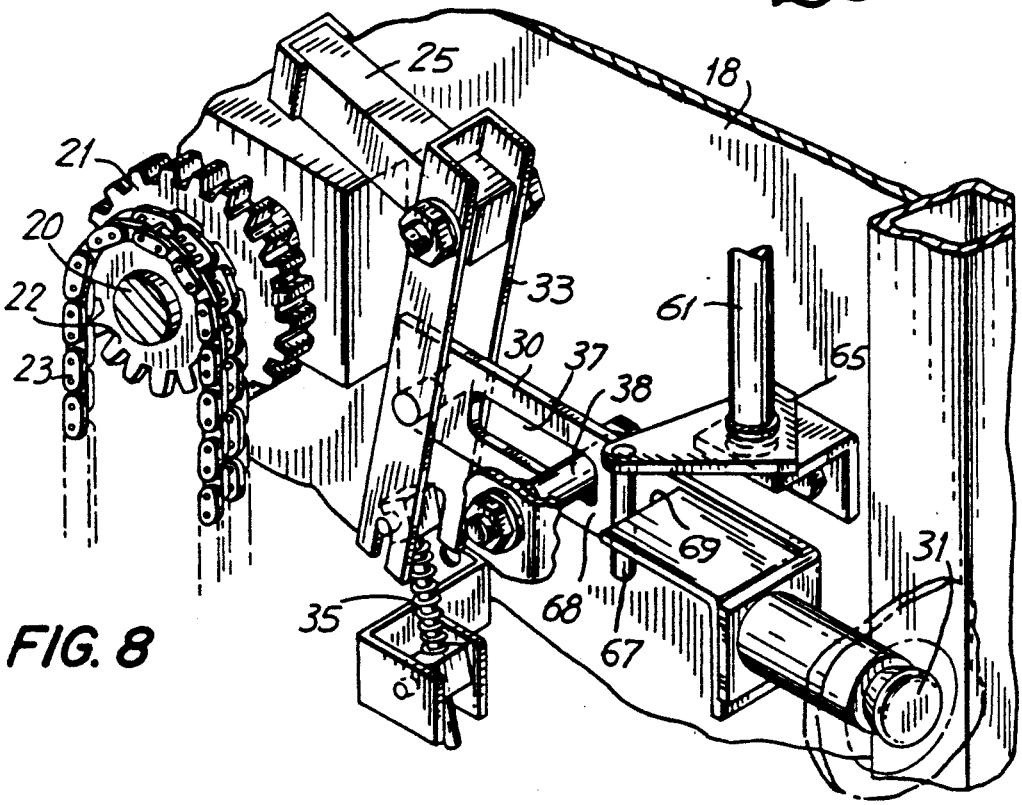
FIG. 8

AUTOMATIC LOCKING DEVICE FOR MOVABLE SHELVING

This invention relates to movable shelving or storage racks, and in particular to automatic locking devices for such movable shelving.

BACKGROUND OF INVENTION

U.S. Pat. No. 4,256,355 describes a movable wheeled storage rack wherein an internal toothed locking wheel is operatively connected to the wheels, and a pair of actuating members connected by pawls to the locking wheel are provided externally of the rack. The user can manually actuate the actuating members, to selectively lock and release the locking wheel, thereby allowing or preventing uni-directional or bi-directional movement of a rack. In a second embodiment described in this patent, the actuating members are located such that they are automatically engaged when moved to a position adjoining the adjacent storage rack to thereby automatically unlock the locking device.

The purpose of this locking scheme is to enable users to selectively lock adjacent storage racks when separated to provide an accessing aisle to prevent injury to the user when present in the aisle between adjacent storage racks. However, it has been found that negligent users sometimes forget to actuate the locking mechanism before entering the aisle between spaced racks.

A known improvement to the system disclosed in the '355 patent attempted to overcome the above disadvantage by providing additional members and linkages that automatically caused locking of the locking mechanism when a storage rack had been moved a first fixed set distance. Before the set distance had been reached, no locking was present and the rack direction could be reversed. After the originally set distance had been reached, the lock engaged and the rack direction could not be reversed, nor could the locking device be reset (disengaged) until after the rack had been moved a second fixed set distance in the original direction beyond the first set distance. However, this attempted solution to the problem proved not entirely satisfactory because some users would stop the rack movement and enter the aisle between separated racks before the rack had reached the first set distance, with the result that the automatic locking mechanism was not engaged. Moreover, if the user had set the automatic lock which became engaged, and then changed his or her mind, the lock could not be released until the rack had been moved another set distance. This therefore required additional unnecessary effort, and proved cumbersome and inefficient in use.

SUMMARY OF INvENTION

An object of the present invention is a movable shelving system provided with a locking mechanism that automatically becomes operable after a rack has been moved a predetermined distance which is smaller than what will provide an aisle space large enough to accommodate an average user.

A further object of the invention is a movable shelving system having an locking mechanism that automatically engages upon a rack of the system moving a distance which is substantially smaller than its permitted movement.

Still another object of the invention is a movable shelving system provided with an automatic locking device that can be overridden and reset by the user at any time and in any rack position.

Another object of the invention is a manually-operated movable shelving system provided with an automatic locking device that can easily be overridden by the user yet will always remain in a position to engage after a rack of the system has been moved from any starting position a predetermined distance.

These and other objects and advantages are achieved, briefly speaking, in accordance with the invention with a novel locking device comprising a connecting member that is connected between adjacent racks and causes by means of a novel mechanism actuation of the means which can be user operated to selectively lock and unlock the rack wheeled drive. The novel mechanism automatically is activated whenever the rack is moved from any position, and is constructed to bring about locking of the wheeled drive after a predetermined movement of the rack. The resultant locking is effective only against reversed direction of movement of the rack, so that continued movement of the rack in the original direction is still allowed.

In a preferred embodiment, the predetermined movement allowed by the mechanism before locking the wheeled drive is smaller than the minimum aisle spacing required to allow an average-sized user access to the rack shelves. Typically, rack movemcnt up to about 36 inches is allowed, which will provide a 36 inch wide aisle for the user to access the shelves on opposed racks. The minimum aisle width that would allow a small adult to access the shelves is about 16–20 inches. In the preferred embodiment, the automatic locking mechanism is constructed to go into effect when a rack has been moved about 16 inches.

In accordance with another aspect of the invention, the connecting member comprises a pivotable linkage connected between adjacent racks and operative to rotate a rod connected to the locking mechanism. The amount of rotation is chosen to cause actuation of the locking device when the pivotable linkage spreads over a predetermined angle. To allow resetting of the locking mechanism after it has engaged, a slip clutch is connected between the pivotable member and the rotatable rod.

In accordance with still another aspect of the invention, the novel mechanism which automatically activates the locking device is so constructed as not to prevent user resetting of the locking device at any time and at any rack position. Hence, whenever the user so decides, he can reset the locking device and immediately reverse the rack direction movement.

In accordance with another aspect of the invention, the locking mechanism is constructed such that it locks an initial time after the rack is moved in the first direction a first predetermined distance (e.g., about 16"–20") from a fully closed position, and once reset after the initial locking, locks again after movement of the rack in the first direction a second predetermined distance (e.g., about 6"–8"). The locking device may also be constructed such that movement of the rack a third predetermined distance is required to lock the device when the rack is near its fully open position. The locking device according to the invention may therefore have a repeat locking feature in which rack distance movement necessary to lock the locking device varies for different portions of overall rack movement. For example, over full rack movement, the distance required to lock the locking device may vary from a larger value, to a smaller value.

In accordance with the preferred embodiment, a novel cam plate is interposed between the pivotable linkage and the rotatable rod and configured such that the rod undergoes only minor rotation when the linkage is moved from an initial closed position to a first intermediate open position, but then undergoes maximum rotation when the linkage is moved from its first to a second intermediate open position. As a result, the locking mechanism will not engage until the aisle width reaches about 16–20 inches, but thereafter, if reset, will engage when the aisle width increases about 6–8 inches.

SUMMARY OF DRAWINGS

The invention will now be described in connection with one exemplary embodiment thereof, in conjunction with the accompanying wherein:

FIG. 1 is a perspective view of one form of shelving system in accordance with the invention;

FIG. 2 is a top plan view of the front region of the system of FIG. 1;

FIG. 3 is a front elevational view along the line 3—3 of FIG. 2;

FIG. 4 is a side, partly cross-sectional view along the line 4—4 of FIG. 2;

FIG. 7 is a view similar to the right half of FIG. 6 showing the mechanism in its locked position;

FIG. 8 is a perspective view of the part of the mechanism shown in FIG. 7, but in its unlocked position;

DETAILED DESCRIPTION OF PREFERRED EMBODIMENT

Figure 9:
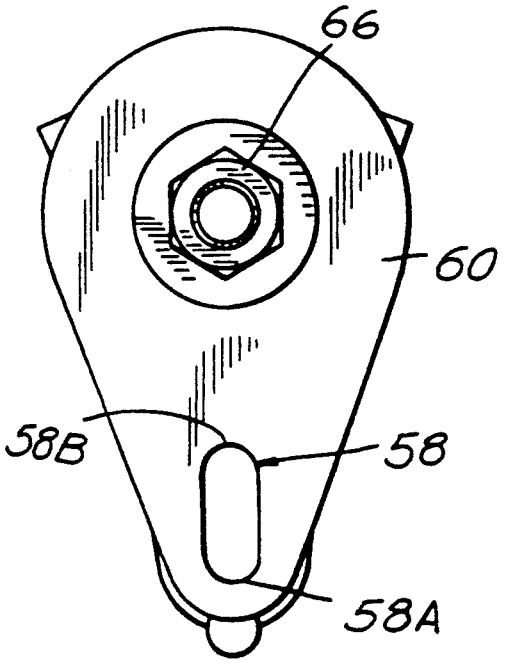
FIG. 9 is a top view, of a cam plate shown in side view in FIG. 4.

The system of the present invention is similar in many respects to that described in U.S. Pat. No. 4,256,355. Hence, only a brief description of the similar elements will be provided herein, and reference is made to said U.S. patent, whose contents are incorporated herein by reference, for further details of the similar aspects.

FIG. 1 illustrates a typical, manually-operated, movable shelving system, comprising plural racks, shelves or sections 10, 11, 12, 13, which are mounted for lateral movement along rails 14, 15. Access to the rack shelves or storage areas is provided by moving apart one or both adjacent rack sections a given distance to form an access aisle or passageway 16. Movement of a rack is accomplished by a hand crank 17 on the front wall or panel 18 which, as shown in FIG. 1, is drivingly connected to wheels under each section, which wheels ride on the rails 14, 15. Actuation CW of the crank 17 causes rack movement to the right, and CCW movement causes rack movement to the left. A guide rail 8 is provided at the top, along which the racks slide, to prevent stack tipping or twisting.

Since the racks are massive especially when loaded, it is possible to injure a user who happens to be in the aisle 16 when a rack is moved in a direction to close the aisle. Hence, locking devices are incorporated inside the front panel to prevent accidental or inadvertent movement of a rack which will close the aisle.

Figure 5:
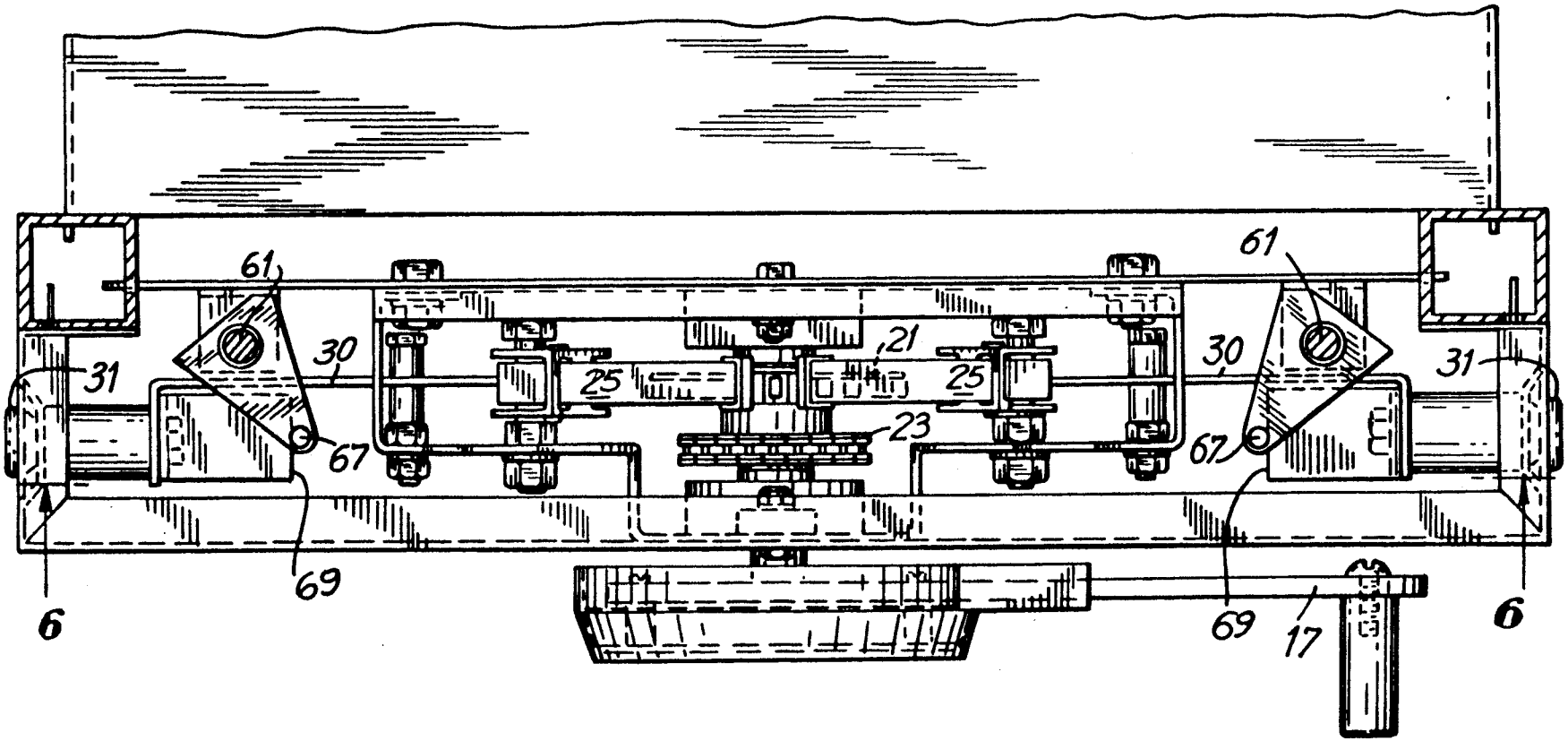
FIG. 5 is a cross-sectional view of the front part of a rack along the line 5—5 of FIG. 1.
Figure 6:
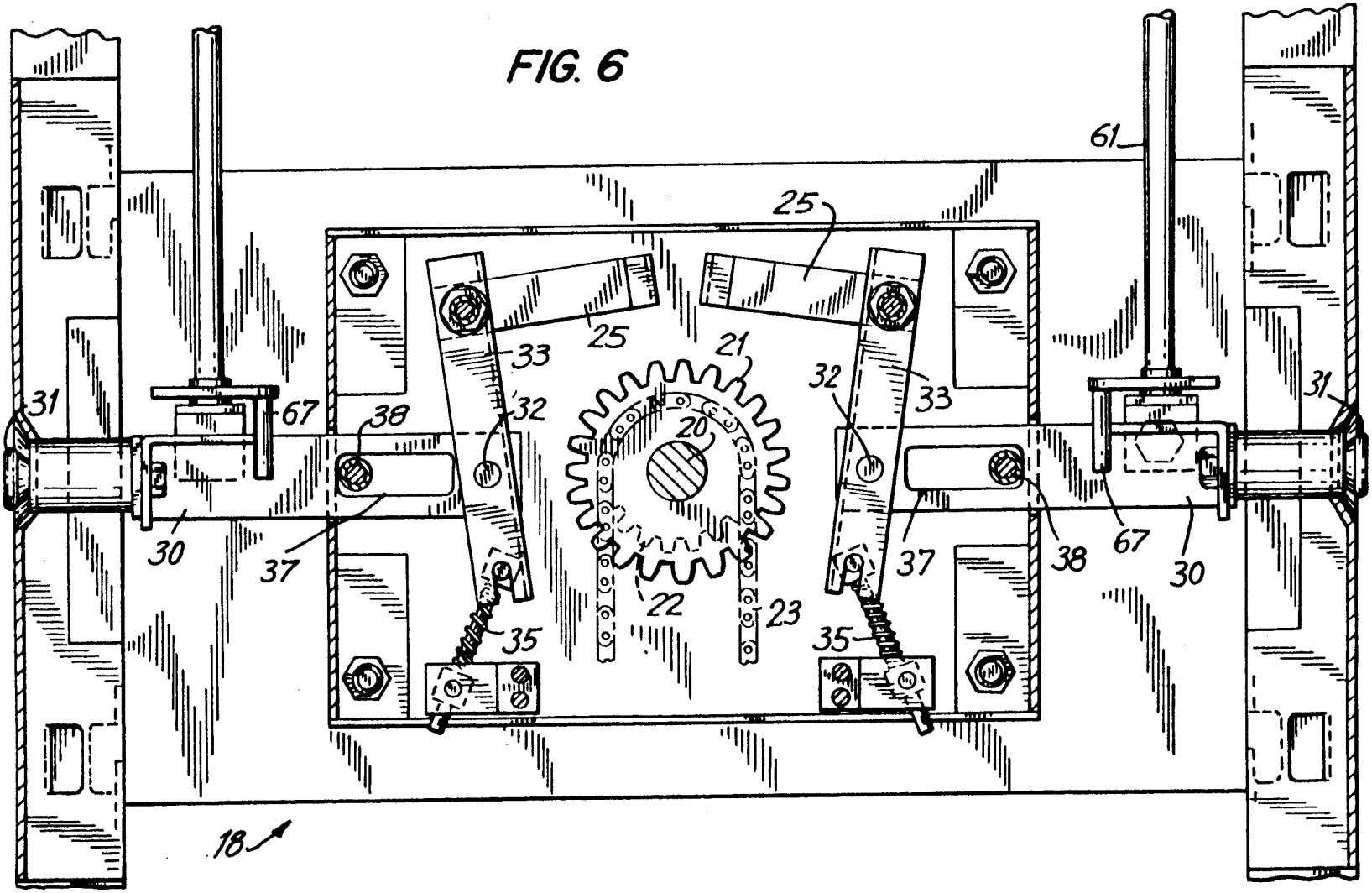
FIG. 6 is a view from the front of the locking mechanism in its unlocked position, taken along the line 6–6 of FIG. 5.

The basic locking mechanism, similar to that described in the referenced patent, comprises a toothed gear wheel. Referring now to FIGS. 5 and 6, the hand crank 17 is connected to a shaft 20 on which a toothed gear wheel 21 is mounted. Also mounted on the shaft 20 and rotatable therewith is a second smaller sprocket wheel 22 engaged by an endless chain 23. The chain extends down to the base of the panel 18 where it drivingly connects to the wheels of the rack. It will be understood that the mechanism shown on the right hand side of FIGS. 5 and 6 is the same as the one on the left hand side and each operates independently and in the same way so it will suffice to provide a description of just one of the mechanisms.

The locking action is effected by causing a member 25 acting as a pawl to engage the teeth of the gear 21 (as shown in FIG. 7) which prevents rotation of the gear and thus the shaft 20 and chain 23 in one direction (CW in FIG. 7), but allows rotation in the opposite direction (CCW in FIG. 7). When the gear teeth are locked as described, the rack cannot be moved to the right but can be moved leftward. When the pawl 25 is disengaged from the teeth (FIG. 6), the rack can be moved in either direction. Actuation of the pawl 25 is effected by a slideable bracket 30, mounted on the panel for horizontal movement. A plunger 31 is connected at one end of the bracket 30 and slides therewith, and the other end of the bracket 30 is connected by a pivot joint 32 to a middle portion of a lever 33. One end of the lever 33 is bolted to the end of the pawl 25, and other lever end is connected by way of a compression spring-biased pin 35 to the panel. This construction operates similarly to a slightly different construction in the referenced patent, and functions as a toggle mechanism having two stable states. In the first state shown in FIG. 6, with the pawl 25 disengaged, the biased pin 35 maintains the lever 33 and pawl 25 in its disengaged position, until the bracket 30 on the right has been moved a distance such that the lever 33 and pin 35 are aligned. A continued slight movement to the right will cause the pin 35 to toggle over to its second state, which will cause the pawl to engage the toothed wheel 21, which will be maintained by the biased pin 35. The reverse movement of the bracket 30 will toggle the lever 33 back to its first state.

The allowable horizontal movement of bracket 30 is determined by a slot 37 in the bracket engaged by a fixed pin 38. It will be evident from the above that the plunger 31 protrudes outward (FIG. 7) from the rack side wall when the lever 25 engages the gear teeth 21. A user who pushes the plunger 31 inward in FIG. 7 will move the bracket 30 to the left causing the pawl 25 to disengage. This will unlock the rack and allow movement to the right, termed resetting the lock.

The automatic locking mechanism is constructed to move the bracket 30 a set amount to cause pawl engagement with the toothed wheel. In a preferred embodiment, the allowable movement depends upon the width of the aisle opening. This is accomplished by providing a novel mechanism which converts aisle spacing increases into movement of the bracket 30. In a preferred embodiment, a pivotable linkage in the form of a scissors element 50 is mounted across each adjacent pair of racks. The scissors element 50, shown in FIGS. 1–4, comprises two arms 51, 52 pivoted 53 at one end to form an included angle Θ. The pivot end 53 is free to move. The opposite ends of the arms 51, 52 are each secured by a linkage generally designated 54 (FIGS. 1 and 3) to the top of the front panel 18. Each secured end (FIG. 4) is bolted 55 via a plate 59 to the panel top, which however allows rotation of the end. To each end is secured, as by welding, a U-shaped bar 56 one of whose ends 57 engages an oversized slot 58 in a tear-drop-shaped cam plate 60. The cam plate, in turn, is secured to a vertically-descending drive rod 61 via a slip clutch 62 comprising two disks 63, 64 with frictionally engaging surfaces. The bottom disk 63 is fixedly secured to the rod 61, and the middle disk 64 is compressed between the lower disk 63 and the cam plate 60. The slip clutch 62 is held in position via a disk spring 65 and a nut 66. Adjustment of the nut 66 changes compression on the disks 63, 64 and the torque at which the disks will slip rather than transmit motion to the drive rod 61. As the scissor elements 51, 52 spread apart, the motion is transmitted and converted via the U-bar end 57 and the cam plate 60 into rotation of the drive rod 61.

Referring now to FIGS. 5–8, the drive rod 61 extends vertically down within the panel 18 and terminates in an L-shaped end piece 65 with a downwardly-extending pin 67 offset from the rod 61. The pin 67 extends into a space 68 behind push bracket 69. As the drive rod 61 rotates (CCW in FIG. 7), the pin 67 is dis placed to the right and when it engages the end of push bracket 69, it displaces the bracket 30 to the right (in FIG. 8). FIG. 8 shows the lock in its unlocked position, with the pawl 25 disengaged from the toothed wheel 21. When the drive rod 61 is rotated, the bracket 30 is displaced toward the right side. After a preset displacement, the toggle mechanism toggles and the pawl 25 engages the toothed wheel 21 to lock the rack against displacement in the reverse direction, which requires CW rotation of the hand crank 17. However, further rotation in the same original direction to the right is allowed as the pawl end 25 slips over the gear teeth. It will be noted that when the locking device has been locked, the plunger 31 protrudes (FIG. 7) from the rack side. The maximum movement of the latter is fixed by the horizontal dimension of the slot 37. If the user continues to move the rack to the right in FIG. 7, the pin 67 stays fixed, which means that the drive rod 61 to which it is fixedly connected can no longer rotate. Yet, the angle $\Theta$ between the scissor arms 51, 52 continues to increase as the aisle widens. This displacement is taken up by the U-bar end 57 which is free to move within the oversized slot 58 in the cam plate 60 thus allowing the scissors to open up to its fullest extent. Additional movements, if desired, can be accommodated by the slip clutch 62. FIG. 2 shows the scissors included angle $\Theta_1$ when the racks are adjacent with no access aisle, and in phantom the scissors included angle $\Theta_2$ when the racks have been spread apart to their maximum allowable spacing.

The dimensioning of the various parts of the controlled locking system determine the size of the rack movement and aisle spacing before the locking device is activated. It is principally determined by the size of the scissors 50, and the shape of the slot 58 in the cam plate 60, which determine the amount of drive rod 61 rotation per degree increase in the included angle $\Theta$, and the length of the slot 37 in the bracket 30. FIG .9 is a plan view of the cam plate 60 which illustrates its general shape and dimensions. For an assumed maximum aisle spacing of about 36 inches, the controlled locking device is preferably proportioned to activate when the rack is moved about 16–20 inches from an initial closed position, which is about the aisel opening that would allow an average-sized person to enter the aisel. If then reset, the mechanism will re-lock after an increase in the aisle spacing of about 6–8 inches until the maximum aisel width of about 36 inches is achieved. This has the advantage that until the aisel width has reached the size that would allow a person to enter, thus creating the problem, there is no need to lock the stacks and thus require the user to reset the mechanism if the user changes his or her mind. But, once the aisel width has reached the point that a user can access the aisle, we want to activate the lock after a shorter stack movement even after the lock has been reset. The interaction between the U-bar end 57 and cam plate slot 58 allows this result.

Figure 9A:
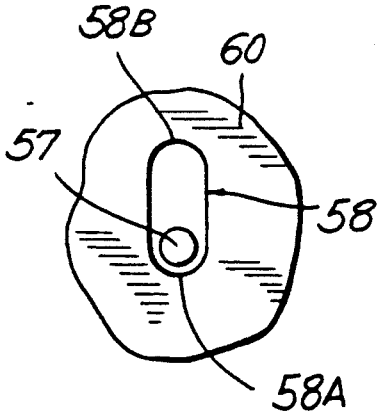
FIG. 9A and 9B are schematic top views of the cam plate showing its interaction with the pivotable linkage.
Figure 9B:
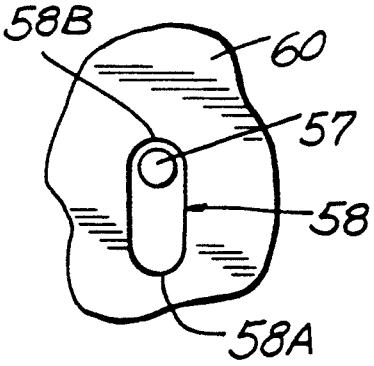

FIG. 4 illustrates the position of the U-bar end 57 in the slot 58 when the aisel is closed and when the aisle is fully opened. FIG. 9A is a top view of that orientation. As a stack is moved to the right, opening up the aisel, the U-bar end 57 moves mainly from one end of the slot 58A (FIG. 9A) to the opposite end 58B (FIG. 9B). Thus, little rotation of the cam plate 60 occurs and little rotation of the drive rod 61. For a typical installation, the cam plate would undergo practically no rotation for the first 12 inches of aisle-opening, and then as the bar end 57 approaches the slot end 58B would just begin to rotate the cam over the next 4–8 inches over about 2°. This would cause only a minor displacement of the bracket 30. Once, the bar end 57 reaches the slot end 58B, then the cam plate 60 would rotate in proportion to the opening of the scissor arms 50, and at the angle spacing when the lock is toggled ON, after another 6–8 inches of aisle increase, the cam plate would have rotated another 4–6°, which would be sufficient to toggle the lock. In this example, the total bracket movement allowed is about 1 inch. From that first intermediate position at the 16–20 inch aisle width, if the lock is then reset, the bracket 30 movement in the opposite direction causes the clutch 61 to slip, so that the bar end 57 remains substantially in the position shown in FIG. 9B. Hence, if then the stack is moved in the same direction to widen the aisel, the cam is immediately rotated and will toggle the lock to the ON position after about another 6–8 inches of movement to a second intermediate position is reached. From this second intermediate position until the aisel width reaches about 30 inches, the lock if reset will continue to engage every 6–8 inches. At that point, the cam plate 60 would have rotated about 20°, and further opening of the scissor's arms will cause the bar end 57 to move in the slot toward its initial end 58A. Thus, over the full aisle width, the lock pre-set aisle movement varies in accordance with the stack position from a large value, then several smaller values. It will be understood that, since the scissor arms are each connected to a similar locking mechanism in adjacent stacks, both locking mesimilar chanisms will toggle ON at about the same time, but each can be reset independently. This has the advantage that, if in FIG. 1, after the locks have toggled on in stacks 10 and 11, and a user then decides to open an aisle between stacks 12 and 13, if the previous user of aisle 16 forgot to reset both locks in stacks 10 and 11 after leaving aisle 16, then the new user need only reset the lock in stack 11 to allow stacks 11 and 12 to be moved to the right to open up the new aisle. The rotation of rod 61 in fixed stack 10 will be taken up by the pin 67 moving in the space 68, and then by the bracket 30 if necessary moving to the left.

For the example used above to illustrate the invention, the angle $\Theta$ will vary in the range of about $\Theta_1=5°$ to about $\Theta_2=35°$, a difference of $\Theta_2-\Theta_1$ of about 30°. The example is meant to be only illustrative and not to be limiting.

As described above, from the locked position shown in FIG. 7, the user can reset the lock, i.e., disengage the pawl 25, by pushing the plunger 31 inward. This will rotate the drive rod 61. The motion at the rod top will be taken up mainly by the slip clutch 62 with little rotation of the cam plate 60. Nevertheless, if at that point the user decides to continue to open up the aisle space, then the lock mechanism will relock. !v That is, after 6–8 inches or so of rack movement to the right, the lock again will automatically activate.

Since the identical mechanism exists at each rack side facing a neighboring rack, any rack movement from any rack position in a direction to open the aisle 16 will automatically cause both racks adjoining the aisle to be locked against movement in the opposite direction after either rack has moved a predetermined or preset distance which is substantially less than its allowable movement. Reverse movement of the rack is permitted only by the user pushing in the plunger 31, or when the rack engages a neighboring rack which results in the plunger being depressed automatically. Thus, the automatic unlocking feature described in the patent remains in the movable storage system of the invention. Moreover, the user can reset the locking device at any time, at whatever position the rack happens to be in.

Since the slideable bracket 30 is essentially the same as described in the referenced patent, the novel locking mechanism can be retrofitted to existing movable shelving that incorporates the patented system. This is readily accomplished by mounting the scissors 50 on top, and extending the drive rod 61 within the front panel 18 and mounting the free end inside as shown in FIG. 8. The scissors arms 51, 52 are adjustable in length as shown in FIG. 2 in order to set the desired aisle spacings for automatic lock activation.

It will be observed that the guide rail 8 is located at the opposite end of the stacks 10–13. This helps to balance the forces generated at the front panels 18 and prevents twisting of the stacks that could interfere with their free lateral movement.

While the scissors structure 50 on the rack is a convenient way of converting large aisle spacing changes into smaller bracket movements, and offers the advantage that it can readily be added to existing installations, other mechanisms capable of performing the same functions are also deemed within the scope of this invention. Similarly, while the slip clutch is preferred as a relatively inexpensive component to allow drive torque to be transmitted to the drive rod until it is stopped or reset, again other similarly functioning components can be substituted.

While the invention has been described and illustrated in connection with preferred embodiments, many variations and modificaions as will be evident to those skilled in this art may be made therein without departing from the spirit of the invention, and the invention as set froth in the appended claims is thus not to be limited to the precise details of construction set forth above as such variations and modifications are intended to be included within the scope of the appended claims.

What is claimed is:

1. A movable shelving system comprising a plurality of sections, driving means for moving at least one section relative to an adjacent section over a path a maximum distance in first and second opposite directions, said maximum distance being substantially greater than a minimum spacing required between said one section and said adjacent section to allow a user to access said one section, locking means responsive to movement of said one section in the first direction over a predetermined distance less than said minimum spacing for automatically locking said one section against movement in the second direction and yet allowing continued movement of said one section in the first direction up to the maximum distance and means for resetting said locking means to release said locking means and allow said one section to be moved in the second direction.

2. The movable shelving system of claim 1, wherein said locking means and said resetting means include cooperating means for resetting said locking means with said one section in substantially any position along said path.

3. The movable shelving system of claim 1, wherein said locking means comprises a slip clutch coupled to said one and adjacent sections for selectively transmitting relative movement of said one and adjacent sections to said locking means or allowing relative movement between said one and adjacent sections without transmitting said relative movement to said locking means depending upon whether said locking means is locked or not and whether said one and adjacent sections are being moved towards or away from each other.

4. The movable shelving system of claim 1, wherein said locking means comprises a scissors-type element having a first arm coupled to said one section and a second arm coupled to said adjacent section, said arms being pivotally coupled together at their respective ends to form an included angle spanning said one and adjacent sections, and means responsive to an increase in said included angle for actuating said locking means to lock said one section.

5. The movable shelving system of claim 4, wherein said activating means comprises a bracket movable into a position to activate said locking means and a rotatable drive rod coupled to said bracket and to said scissors-type element to move said bracket into said position in response to said increase in the included angle of said scissors-type element.

6. A movable shelving system comprising a plurality of sections, manual driving means for moving at least one section relative to an adjacent section over a path a given distance in first and second opposite directions, a locking means for automatically locking said one section against movement in the second direction after movement in the first direction a predetermined distance and means for resetting said locking means to release said locking means and allow said one section to be moved in the second direction with said one section in substantially any position along said path.

7. The movable shelving system of claim 6, wherein said locking means including at least one slip clutch coupled to said one and adjacent sections for selectively transmitting relative movement of said one and adjacent sections to said locking means or allowing relative movement between said one and adjacent sections without transmitting said relative movement to said locking means depending upon whether said locking means is locked or not and whether said one and adjacent sections are being moved towards or away from each other.

8. The movable shelving system of claim 7, wherein said locking means comprises a movable bracket movable into and out of a locking position and means coupled to said one and said adjacent sections for movign said bracket into said locking position in response to movement of said one section in the first direction, a locking mechanism coupled to said bracket for locking said locking means when said bracket is in said locking position and means for toggling said locking mechanism from an unlocked to a locked state when said bracket is moved to said locking position.

9. The movable shelving system of claim 8, wherein said bracket is movable from said locked position to an unlocked position bys adi resetting means to cause said locking mechanism to unlock said locking means, said resetting means including means accessible for manual activation by a user for moving said bracket from its locked position to its unlocked position in any position of said one section in which said manual activation means is accessible.

10. The movable shelving system of claim 8, wherein said bracket moving means comprises a scissors-type element having a first arm coupled to said one section and a second arm coupled to said adjacent section, said first and second arms being pivotally conencted together at their respective ends to form an included angle that varies form an angle $\Theta_1$ with no separation between said one and said adjacent sections to an angle $\Theta_2$ with maximum separation between said one and said adjacent sections, said bracket being movable from its unlocked to its locked position when said included angle increases to a predetermined value substantially less than one-half of $\Theta_2$-$\Theta_1$.

11. The movable shelving system of claim 10 wherein a said slip clutch couples a said first arm to said bracket for selectively transmitting pivoting movement of said first arm to said bracket or allowing relative pivoting movement between said first arm and said bracket upon relative movement of said one section and said adjacent section depending upon whether said bracket is in said locked or unlocked position, whether said locking means is locked bys aid locking mechanism or not and whether said one and adjacent sections are moved toward or away from each other.

12. The movable shelving system of claim 11, wherein said locking means furthe rincludes a drive rod coupling a said slip clutch and said bracket.

13. A movable shelving system comprising a plurality of sections, manual driving means for moving at least one section relative to an adjacent section over a path a given distance in first and second opposite directions, a locking mechanism for locking said one section against movement in the second direction, means for automatically causing said locking mechanism to lock when said one section is moved in said first direction an amount dependent upon the position of said one section, and means for resetting said locking mechanism to release said locking mechanism and allow said one section to be moved in the second direction.

14. The movable shelving system of claim 13, wherein said means for causing said locking mechanism to lock comprises a drive rod for activating said locking mechanism and means coupled to said one section and to said adjacent section for rotating said drive rod different amounts in accordance with the position of said one section relative to said adjacent section.

15. The shelving system of claim 14, wherein said drive rod rotating means comprises a cam mechanism coupled to said drive rod, a scissors-type element having one arm coupled to said cam mechanism and anotehr arm coupled to said adjacent section and pivotally coupled together at respective ends thereof.

16. The shelving ssystem of claim 15, wherien said cam mechanism is configured such that said drive rod undergoes minimum rotation during an initial phase of relative movement between said first and said adjacent sections in the first direction and undergoes maximum rotation during a later phase of said relative movement in the first direction.

17. A method of operating a movable shelving system comprising a plurality of sections, manual driving means for moving at least one section relative to an adjacent section over a maximum distance in first and second opposite direcitons and an automatic locking mechanism which locks the one section against movement in the second direction after movement in the first direction, comprising the steps of:

(a) determining the amount of movement of the one section relative to the adjacent section in the first direction from any position from which the one section is moved, (b) automatically activating and setting the locking mechanism when said amount reaches a predetermined value, (c) allowing continued movement of the one section in the first direction after the locking mechanism has been set, (d) allowing resetting of the locking mechanism substantially in any position of the one section to allow movement of the one section in the second direction.

18. The method of claim 17, wherein the step of determining the amount of movement of the one section comprises converting displacement of the one section relative to the adjacent section to rotary motion and coupling the rotary motion to the locking mechanism.

* * * * *